US005089162A

United States Patent [19]

Rapisarda et al.

[11] Patent Number: 5,089,162

[45] Date of Patent: Feb. 18, 1992

[54] CLEANING COMPOSITIONS WITH BLEACH-STABLE COLORANT

[75] Inventors: Anthony A. Rapisarda, Elmhurst, N.Y.; Carlene M. Mantell, Palisades Park, N.J.

[73] Assignee: Lever Brothers Company, Division of Conopco, Inc., New York, N.Y.

[21] Appl. No.: 348,549

[22] Filed: May 8, 1989

[51] Int. Cl.[5] ..... C11D 3/28; C11D 3/395; C11D 3/40; C11D 3/50

[52] U.S. Cl. ..... 252/102; 252/90; 252/94; 252/95; 252/99; 252/174.11; 252/174.12; 252/174.23; 252/174.24; 252/174.25; 252/187.24; 252/187.25; 252/187.26; 252/187.33; 252/187.34; 252/524; 252/542; 252/DIG. 14

[58] Field of Search ..... 252/187.24, 187.25, 252/187.26, 187.33, 187.34, 102, 98, 174.11, 524, 542, 174.25, 94, 95, 99

[56] References Cited

U.S. PATENT DOCUMENTS

| | | | |
|---|---|---|---|
| 3,589,545 | 5/1971 | Rapisarda | 259/3 |
| 3,609,088 | 9/1971 | Sumner | 252/99 |
| 3,812,042 | 5/1974 | Verdier | 252/90 |
| 3,816,320 | 6/1974 | Corliss | 252/99 |
| 3,860,525 | 1/1975 | Bechtold | 252/99 |
| 3,936,386 | 2/1976 | Corliss et al. | 252/99 |
| 4,113,645 | 9/1978 | DeSimone | 252/98 |
| 4,238,192 | 12/1980 | Kandathil | 8/111 |
| 4,271,030 | 6/1981 | Brierley et al. | 252/98 |
| 4,427,417 | 1/1984 | Porasik | 23/313 |
| 4,464,281 | 8/1984 | Rapisarda et al. | 252/174.21 |
| 4,474,677 | 10/1984 | Foxlee | 252/98 |
| 4,511,487 | 4/1985 | Pruhs et al. | 252/99 |
| 4,515,705 | 5/1985 | Moeddel | 252/174.12 |
| 4,554,091 | 11/1985 | Jones et al. | 252/187 |
| 4,606,849 | 8/1986 | Ansari et al. | 252/522 |
| 4,623,476 | 11/1986 | Nayar et al. | 252/94 |
| 4,714,562 | 12/1987 | Roselle et al. | 252/94 |

FOREIGN PATENT DOCUMENTS

| | | |
|---|---|---|
| 52-69415 | 6/1977 | Japan . |
| 61-238900 | 10/1986 | Japan . |
| 62-89800 | 4/1987 | Japan . |
| 2164350 | 3/1988 | United Kingdom . |

OTHER PUBLICATIONS

*Color Index*, v. 4 and 5, Published by The Society of Dyers & Colorists (1971).

"Formation of Nonaromatic Products in the Chlorination of Simple Substituted Aromatic Ethers", J. Org. Chem., v. 47, #27, pp. 5270–5275 (1982).

"Chlorination of Phenols with Chlorine and t-Butyl Hypochlorite", J. Org. Chem., v. 39, #8, pp. 1160–1164 (1973).

*Primary Examiner*—Paul Lieberman
*Assistant Examiner*—A. Beadles-Hay
*Attorney, Agent, or Firm*—A. Kate Huffman

[57] ABSTRACT

Cleaning compositions contain a bleach-stable water dispersible or water-soluble yellow colorant and either a chlorine bleach or an oxygen bleach. The compositions may take the form of automatic dishwashing detergents, in granular or liquid form, and preferably also have a lemon-like scent to compliment the yellow color.

14 Claims, No Drawings

CLEANING COMPOSITIONS WITH BLEACH-STABLE COLORANT

FIELD OF THE INVENTION

This invention relates to cleaning compositions which include chlorine bleach along with a bleach-stable colorant, especially compositions useful for automatic dishwashing.

BACKGROUND OF THE INVENTION

Cleaning compositions which contain chlorine bleach are colored for identification. Confusion must be avoided between these detergents and other white granular products used in the kitchen. Avoidance of such confusion is desirable because these bleach compositions are usually alkaline and corrosive to human skin, and so can be hazardous when improperly used. They should not resemble such kitchen powders as salt or sugar.

Cleaning compositions frequently have incorporated a colorant. (The term "colorant" is used throughout this specification to mean any type of color-imparting compound, whether a dye, pigment or other material.) Thus, U.S. Pat. Nos. 4,623,476 (Nayar et al.) and 4,474,677 (Foxlee) describe aqueous bleach compositions with blue-green or blue colorants not degraded by the harsh bleach environment.

Other colorants may be employed in a bleach-containing environment when the colorant is protected in some way. U.S. Pat. No. 4,554,091 (Jones et al.) thus describes a thickened aqueous bleach solution in which the colorant agent is enrobed in a polymer latex to form a chromophore. And in U.S. Pat. No. 4,271,030 (Brierley et al.), the pigment remains suspended as particles in the bleach compositions, exposing little of itself to the aqueous bleach environment. Even colorants which are not bleach-stable may be incorporated in cleaning compositions: in U.S. Pat. No. 4,464,281 (Rapisarda et al.), yellow bleach-vulnerable dyes were incorporated in autodish compositions and, prior to addition of bleach, these compositions were "pre-conditioned" by contact with warm air. The resulting powder is color-stable.

Bleach-stable colorants may also be used. U.S. Pat. No. 4,714,562 (Rosselle et al.) describes automatic dishwashing compositions incorporating certain bleach-stable yellow stilbene dyes; these compositions are said to enjoy color stability despite the presence of bleach and substantial alkalinity as either aqueous liquid or spray-dried powder.

It is an object of the present invention to identify further bleach stable yellow colorants, which may suitably be incorporated in cleaning compositions, particularly autodish compositions.

It is also an object of this invention to impart stable color to bleach-containing and/or perfume-containing cleaning compositions.

It is another object of this invention to impart a lemon-like scent to the cleaning composition in order to complement the yellow color thereof.

SUMMARY OF THE INVENTION

The invention relates to cleaning compositions containing a bleach, which incorporate one or more relatively water-soluble or dispersible colorants which are color-stable in the presence of the chlorine bleach.

Applicants ave discovered that certain colorants may be incorporated in aqueous cleaning compositions containing chlorine bleach to impart a color which remains relatively constant over time.

In particular, the invention relates to a cleaning composition which comprises:

a) chlorine bleach in an amount providing 0.01–5% available chlorine; and b) 0.0005–0.2% of a relatively water-soluble colorant which is color stable to chlorine bleach.

In a granular form embodiment, the composition may further comprise 5–90% builder; 0–8% surfactant; 1–40% silicate; and 0–60% filler; while a liquid or gel form may further comprise 5–90% builder, 1–40% silicate, 0–8% of a thickener, 0 to 5% surfactant and stabilizer, 0 to 2% of a defoamer and aqueous liquid. (All percentage amounts in this composition are percentage by weight, unless otherwise indicated.)

Thus, a cleaning composition may comprise chlorine bleach in an amount providing 0.01 to 5% available chlorine, 0.0005–0.2% of a relatively water-soluble colorant which is color stable to chlorine bleach and is selected from the group consisting of Pigment Yellow 14, Pigment Yellow 74, Pigment Yellow 104, Pigment Yellow 108, Pigment Yellow 109, Pigment Yellow 155, Direct Dye Colour Index Number 19550, Direct Yellow 28, Direct Yellow 29, zinc chromate and mixtures thereof.

Certain of the colorants which are bleach stable may nevertheless stain the objects to be cleaned. Non-staining colorants are preferred for use in cleaning compositions.

The cleaning composition may be in granular or liquid form. In one embodiment, the cleaning composition is an automatic dishwashing detergent. The composition in either form may also incorporate 0.001–2% perfume. Preferred liquid and gel compositions incorporate a perfume composition which does not drastically reduce the available chlorine level or which imparts a lemon scent to the liquid or gel autodish composition without causing color fading.

Whether the cleaning composition is solid, liquid or gel, it may be packaged in a container which is at least partly transparent or translucent in order to display the pleasant color of the composition, e.g., a bottle, a box or a pouch or "sachet".

The invention also relates to cleaning compositions which include oxygen bleach and one or more of the water-dispersible or water-soluble colorants mentioned above. These compositions may or may not include chlorine bleach.

DETAILED DESCRIPTION OF THE INVENTION

The composition of the invention, which may be in granular, liquid or gel form, contains chlorine bleach, a bleach-stable and water-soluble or water-dispersible yellow colorant, and detergent builder. Among other components of the composition are surfactant, filler, thickener, stabilizer, and water.

In general, the cleaning composition comprises:

a) from about 0.01 to about 5% available chlorine from a chlorine bleach; and b) from about 0.0005 to about 0.2% of a chlorine bleach stable and water-soluble or water-dispersible yellow colorant.

When in granular form, the composition further comprises:

c) from about 1 to about 40% silicate;

d) from about 5 to about 90% builder or mixtures thereof;

e) from about 0.1 to about 10% surfactant; and f) from about 0 to about 60% filler material.

When in liquid or gel form, the composition further comprises:

c) from about 1 to about 40% silicate;

d) from about 5 to about 90% builder or mixtures thereof;

e) from about 0 to about 5% surfactant;

f) from about 0 to about 8% of a thickener;

g) from about 0 to about 5% of a stabilizer;

h) from about 0 to about 2% of a defoamer; and i) balance water.

BLEACHING AGENT

A wide variety of chlorine bleaching agents may be employed for use with these cleaning compositions.

Among the suitable chlorine bleaches are heterocyclic N-bromo and N-chloro imides such as trichlorocyanuric, tribromocyanuric, dibromo- and dichlorocyanuric acids, and salts thereof with water-solubilizing cations such as potassium and sodium. An example of the hydrated dichlorocyanuric acid is Clearon CDB56, a product manufactured by the FMC Corporation. Such bleaching agents may be employed in admixtures comprising two or more distinct chlorine donors. An example of a commercial mixed system is one available from the Monsanto Chemical Company under the trademark designation "ACL-66" (AC signifying "available chlorine" and the numerical designation "66", indicating the parts per pound of available chlorine) which comprises a mixture of potassium dichloroisocyanurate (4 parts) and trichloroisocyanurate acid (1 part).

Other N-chloro imides may also be used such as N-chlorinated succinimide, malonimide, phthalimide and naphthalimide. Other compounds include the hydantoins, such as 1,3-dibromo and 1,3-dichloro-5,5-dimethylhydantoin, N-monoohloro-C,C-dimethylhydantoin, 1,3-dichloro 5-isobutylhydantoin; 1,3-dichloro 5-methyl-5-ethylhydantoin; 1,3-dichloro 5,5-isobutylhydantoin; 1,3-dichloro 5-methyl-5-n-amylhydantoin, and the like. Further useful hypohalite liberating agents comprise trichloromelamine.

Dry, particulate, water-soluble anhydrous inorganic salts are likewise suitable for use herein such as lithium, sodium or calcium hypochlorite.

The hypochlorite liberating agent, may, if desired, be provided in a form of a stable solid complex or hydrate. Examples include sodium benzene-sulfo-chloroamine-dihydrate, calcium hypochlorite tetrahydrate, etc. Chlorinated trisodium phosphates formed by the reaction of the corresponding sodium hypohalite solution with trisodium phosphate (and water if necessary) likewise comprise efficacious materials.

Preferred chlorinating agents include potassium and sodium dichloroisocyanurate dihydrate, chlorinated trisodium phosphate and calcium and sodium hypochlorite. Particularly preferred is sodium dichloroisocyanurate dihydrate. Sodium hypochlorite is most preferred for liquids and gels. Preferred concentrations of all of these materials should be such that they provide about 0.01 to 5% available chlorine, preferably 0.2 to about 1.5% available chlorine. Hypochlorite liberating compounds may generally be employed in automatic dishwashing detergents at a level of from 0.5 to 5% by weight, preferably from 0.5 to 3% of the cleaning compositions.

Suitable chlorine-releasing agents are also disclosed in the ACS monograph entitled "Chlorine-Its Manufacture, Properties and Uses" by Sconce, published by Reinhold in 1962. This book is incorporated by reference.

Oxygen bleaches may supplement the chlorine bleach in the cleaning composition. Alteratively, the oxygen bleach may be the only bleach material present, the cleaning composition being substantially free of chlorine bleaching agents. (Such non-chlorine bleach compositions are especially preferred if enzymes are to be incorporated.)

Among the oxygen bleaches which may be included in the invention are alkali metal and ammonium salts of inorganic peroxygen compounds such as perborates, percarbonates, persulfates, dipersulfates and the like. Generally the inorganic oxygen compound will be used in conjunction with an activator such as TAED (tetraacetyl ethylene diamine), sodium benzoyl oxybenzene sulfonate or choline sulfophenyl carbonate or a catalyst such as manganese or other transition metal, as is well known in the bleaching art. Insoluble organic peroxides such as diperoxydodecanedioic acid (DPDA) or lauroyl peroxide may also be used. Generally, the peroxygen compounds are present at a level of from 0.5 to 20% by weight, 0.005 to 5% catalyst and 1 or 0.5 to 30% activator.

COLORANT

Suitable colorants for the cleaning composition impart a yellow color and are water-soluble or water-dispersible. These colorants are also "bleach-stable" i.e. their color is not substantially altered or faded by chlorine bleach. The term colorant is understood herein to embrace all coloring materials, e.g. pigments dyes, and other materials.

As Example 1 below shows, the suitable yellow colorants include: Direct Yellow 28; Pigment Yellow 14; Pigment Yellow 74; Pigment Yellow 108; Pigment Yellow 109; Pigment Yellow 155; and zinc chromate (ZnO.CrO3).

Direct Yellow 28 is a monoazo colorant with the following structure:

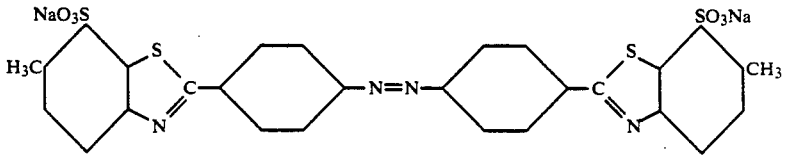

Direct Yellow 28 is described in the *Colour Index*, 3rd Ed., Society of Dyers and Colourists, Bradford, England (1971) and is given Colour Index ("CI") Number 19555. Direct Yellow 28 is available commercially under the name "Pyrazol Yellow BG 250%" ex Sandoz Chemicals, Inc. and "Yellow Shade 18569" ex Tricon Colors, Inc.

Also suitable as a colorant in the cleaning composition are Direct Yellow 29, which has CI number 19556 and Direct Dye with CI Number 19550. These colorants have the following structures:

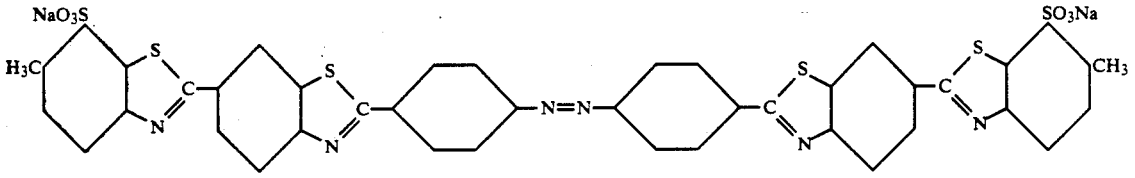

Direct Yellow 29

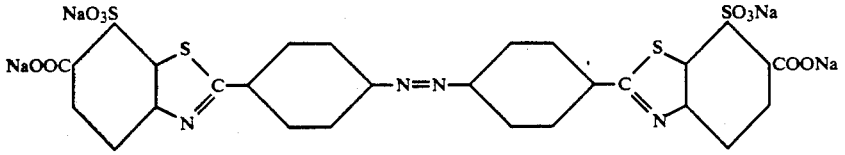

Direct Dye C.I. Number 19550

Pigment Yellow 14, 74 and 108 are further described in the *Colour Index* and have CI numbers 21095, 11741 and 68420 respectively. The remaining colorants are well known in the coloring art. The *Colour Index* descriptions of all the above colorants are incorporated herein by reference.

The cleaning composition may incorporate colorant in an amount from 0.0005 to 0.2% by weight of the composition. One or more colorants may be used. Preferably, there is used 0.001 to 0.1% colorant, and most preferably 0.002 to 0.05%.

DETERGENT BUILDER MATERIALS

The cleaning compositions of this invention can contain all manner of detergent builders commonly taught for use in automatic dishwashing compositions. The builders can include any of the conventional inorganic and organic water-soluble builder salts, or mixtures thereof and may comprise from about 5 to about 90% by weight of the cleaning composition.

Typical of the well known inorganic builders are the sodium and potassium salts of the following: pyrophosphate, tripolyphosphate, orthophosphate, carbonate, bicarbonate, sesquicarbonate and borate. Other non-phosphorus salts including crystalline and amorphous aluminosilicates may be used as well.

Particularly preferred builders can be selected from the group consisting of sodium tripolyphosphate, sodium carbonate, sodium bicarbonate and mixtures thereof. When present in these compositions, sodium tripolyphosphate concentrations will range from about 2% to about 40%; preferably from about 5% to about 30%. Sodium carbonate and bicarbonate when present can range from about 10% to about 50%; preferably from about 20% to about 40% by weight of the cleaning composition. Potassium pyrophosphate is a preferred builder in gel formulations, where it may be used at from about 3 to about 30%, preferably from about 10 to about 20%.

Organic detergent builders can also be used in the present invention. They are generally sodium and potassium salts of the following: citrate, nitrilotriacetates, phytates, polyphosphonates, oxydisuccinates, oxydiacetates, carboxymethyloxy succinates, tetracarboxylates, starch, oxidized heteropolymeric polysaccharides, and polymeric polycarboxylates such as polyacrylates of molecular weight of from about 5,000 to about 200,000. Polyacetal carboxylates such as those described in U.S. Pat. Nos. 4,144,226 and 4,146,495 may also be used.

Sodium citrate is an especially preferred builder. When present it is preferably available from about 1% to about 35% of the total weight of the detergent composition.

The foregoing detergent builders are meant to illustrate but not limit the types of builder that can be employed in the present invention.

SURFACTANTS

Generally, low foaming or defoaming surfactants are used in the cleaning composition to avoid excessive foaming. Consequently, many nonionic surfactants are suitable for use in the composition.

Nonionic synthetic detergents can be broadly defined as compounds produced by the condensation of alkylene oxide groups (which may be used in "block" or "random mixture" form) with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative but not limiting examples of the various chemical types as suitable nonionic surfactants include:

(a) polyoxyethylene or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid.

(b) polyoxyethylene or polyoxypropylene condensates of aliphatic alcohols, whether linear- or branched-chain and unsaturated or saturated, containing from about 6 to about 24 carbon atoms and incorporating from about 5 to about 50 ethylene oxide or propylene oxide units in block ethylene oxide/propylene oxide or in random mixture configurations. Suitable alcohols include the "coconut" fatty alcohol, "tallow" fatty alcohol, lauryl alcohol, myristyl alcohol and oleyl alcohol. Particularly preferred nonionic surfactant compounds in this category are the "Neodol" type products, a registered trademark of the Shell Chemical Company.

Included within this category are nonionic surfactants having the formula:

$$RO-(\underset{\underset{R'}{|}}{CH_2CHO})_x(CH_2CH_2O)_y(\underset{\underset{R''}{|}}{CH_2CHO})_z-H$$

wherein R is a linear, alkyl hydrocarbon having an average of 6 to 10 carbon atoms, R' and R'' are each linear alkyl hydrocarbons of about 1 to 4 carbon atoms, x is an integer from 1 to 6, y is an integer from 4 to 15 and z is an integer from 4 to 25. Surfactants of this category may have defoaming character and are preferred. A particularly preferred example of this category is Poly-Tergent SLF-18, a registered trademark of the Olin Corporation, New Haven, Conn. Poly-Tergent SLF-18 has a composition of the above formula where R is a $C_6$–$C_{10}$ linear alkyl mixture, R' and R'' are methyl, x averages 3, y averages 12 and z averages 16. Another surfactant from this category has the $$C_{8-10}O(CH_2CH_2O)_{7.81}(\underset{\underset{CH_3}{|}}{CH_2CHO})H_{14.45}$$

(c) polyoxyethylene or polyoxypropylene condensates of alkyl phenols, whether linear- or branched-chain and unsaturated or saturated, containing from about 6 to about 12 carbon atoms and incorporating from about 5 to about 25 moles of ethylene oxide or propylene oxide.

(d) polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tristearate, sorbitan monooleate, and sorbitan trioleate. The polyoxyethylene chains may contain between about 4 and 30 ethylene oxide units, preferably about 20. The sorbitan ester derivatives contain 1, 2 or 3 polyoxyethylene chains dependent upon whether they are mono-, di-, or tri-acid esters.

(e) polyoxyethylene-polyoxypropylene block polymers having the formula:

$$HO(CH_2CH_2O)_a(CH(CH_3)CH_2O)_b(CH_2CH_2O)_cH$$

wherein a, b and c are integers reflecting the respective polyethylene oxide and polypropylene oxide blocks of said polymer. The polyoxyethylene component of the block polymer constitutes at least about 40% of the block polymer. The material preferably has a molecular weight of between about 2,000 and 10,000, more preferably from about 3,000 to about 6,000. These materials are well known in the art. They are available under the trademark "Pluronics", a product of BASF-Wyandotte Corporation.

The granular forms of the composition have from about 0.1 to about 10% by weight of nonionic surfactant. Preferably, the level of nonionic is from about 1 to about 5% and most preferably 2 to 4% by weight of the cleaning composition.

In formulating liquid or gel cleaning compositions within the invention, there must be due regard for the incompatibility of many alkoxylated nonionic surfactants with chlorine bleach. Surfactant may be entirely omitted. Alternatively, one or more low-foaming anionic surfactants is employed in the liquid or gel compositions at levels from about 0.05 to about 5%. Typical liquid autodish compositions have from 0 to 3% of such surfactants and typical gels have 0.05 to 3% of such surfactants, preferably from about 0.1 to about 3%.

Suitable anionic surfactants include alkyl sulfonates and sulfates containing from about 8 to about 20 carbon atoms; alkyl benzene sulfonates and sulfates containing from about 6 to about 13 carbon atoms in the alkyl group, and the preferred low-sudsing mono- and/or di-$C_8$–$C_{14}$ alkyl diphenyl oxide mono- and/or di-sulfonates and -sulfates. The mono- or di-$C_{8-14}$ alkyl diphenyl oxide mono- and/or di-sulfates are sold by Dow under trade names Dowfax 2A-1 and Dowfax 3B-2.

Other suitable surfactants for the cleaning compositions include amine oxides, phosphine oxides, sulfoxides, and betaines.

SILICATE

The compositions of this invention contain sodium or potassium silicate at a level of from about 1 to about 40% by weight of the cleaning composition. This material is employed as a cleaning ingredient, source of alkalinity, metal corrosion inhibitor and protector of glaze on china tableware. Especially effective is sodium silicate having a ratio of $SiO_2$:$Na_2O$ of from about 1.0 to about 3.3, preferably from about 2 to about 3.2. Some of the silicate may be in solid form.

FILLER

An inert particulate filler material which is water-soluble may also be present in granular compositions. This material should not precipitate calcium or magnesium ions at the filler use level. Suitable for this purpose are organic or inorganic compounds. Organic fillers include sucrose, sucrose esters and urea. Representative inorganic fillers include sodium sulfate, sodium chloride and potassium chloride. A preferred filler is sodium sulfate. Its concentration may range from 0% to 60%, preferably about 10% to 20% by weight of the cleaning composition.

THICKENERS AND STABILIZERS

Thickeners are desirable for liquid and gel compositions. Thixotropic thickeners such as smectite clays including montmorillonite (bentonite), hectorite, saponite, and the like may be used. Silica, silica gel, and aluminosilicate may also be used as thickeners. Salts of polyacrylic acid (of molecular weight of from about 300,000 up to 6 million) may also be used alone or in combination with other thickeners. Use of clay thickeners for automatic dishwashing compositions is disclosed for example in U.S. Pat. Nos. 4,431,559; 4,511,487; 4,740,327, 4,752,409. Use of salts of polymeric carboxylic acids is disclosed for example in UK Patent Application GB 2,164,350A. Commercially available bentonite clays include Korthix H and VWH ex Combustion Engineering, Inc.; Polargel T ex American Colloid Co.; and Gelwhite clays (particularly Gelwhite GP and H) ex English China Clay Co. Polargel T is preferred as imparting a whiter "cleaner" appearance to the composition than other clays.

For gel formulations, particularly if a clear gel is desired, a chlorine stable polymeric thickener is particularly useful. U.S. Pat. No. 4,260,528 discloses natural gums and resins for use in clear autodish detergents, which are not chlorine stable. Acrylic acid polymers manufactured by B. F. Goodrich and sold under the trade name "Carbopol" have been found to be effective for production of clear gels, and Carbopol 940, having a molecular weight of about 4,000,000, is particularly preferred for maintaining high viscosity with excellent chlorine stability over extended periods. Further suitable chlorine-stable polymeric thickeners are described in U.S. patent application Ser. No. 157,425, filed Feb. 17, 1988 by Elliott et al. This application is incorporated by reference herein.

The amount of thickener employed in the composition is from 0 to about 8%, preferably 1–5%.

Stabilizers and/or co-structurants such as long chain calcium and sodium soaps and $C_{12}$ to $C_{18}$ sulfates are detailed in U.S. Pat. Nos. 3,956,158 and 4,271,030, and the use of other metal salts of long chain soaps is detailed in U.S. Pat. No. 4,752,409. The amount of stabilizer which may be used in the liquid cleaning compositions is from about 0.01 to about 5% by weight of the composition, preferably 0.1–2%. Such stabilizers are optional in gel formulations.

DEFOAMER

Liquid and gel formulations of the cleaning composition generally further include a defoamer. Suitable defoamers include mono- and distearyl acid phosphate, silicone oil and mineral oil. Even if the cleaning composition has only defoaming surfactant, the defoamer assists to minimize foam which food soils can generate. The composition may include 0.02 to 2% by weight of defoamer, or preferably 0.05–1.0%.

PERFUME

A further embodiment of the invention is a cleaning composition incorporating a perfume composition, more particularly a liquid autodish composition comprising a perfume composition. It is common in the perfuming art to combine many raw material scents which impart to a product a pleasant, distinctive scent with many "notes" or nuances. In this specification, the term "perfume" indicates the single raw material fragrant compound while the term "perfume composition" denotes the mixture of perfumes which is added to a product.

In granular cleaning compositions of the invention, there is little interaction between the perfume and the bleach. The level of active chlorine from in the composition falls only slightly over time. Due to the granular form of the composition, perfume is not very vulnerable to bleach attack. Accordingly, any perfume may generally be incorporated in granular compositions. By contrast, liquid and gel autodish compositions suffer ongoing loss of available chlorine. Moreover, as applicants have discovered, addition of perfume to these compositions may drastically reduce the level of available chlorine. Without in any way limiting the invention described herein, it is applicant's belief that the presence of perfume allows bleach to attack otherwise bleach-resistant compounds, such that greater amounts of bleach react over time.

Perfumes were screened for their effect on bleach activity loss. The results in Example 5 below indicate to what extent each perfume reduces bleach levels. Thus, a further embodiment of the invention is a liquid or gel autodish composition comprising one or more perfumes which do not reduce available chlorine below 80% of the initial level after 1 week at 72° F., or below 5% after 4 weeks at 105° F.

Further suitable perfumes include: 4-acetyl-6-tertiarybutyl-1,1-dimethyl indan, 6-acetyl-1,1,3,4,6-hexamethyl tetrahydro naphthalene, allyl trimethyl hexanoate, alpha ionone, alpha beta ionone, amyl cinnamic aldehyde, amyl salicylate, anisaldehyde, benzyl acetate, benzyl salicylate, beta naphthyl ethyl ether, benzyl isoeugenol, beta gamma hexenol, cinnamic alcohol, citral, citronellol, citronella, citronellal, citrathal, coumarin, dihydromercenol, dihydro-nor-dicyclopentadienyl acetate, dihydro-nor-dicyclopentadienyl propionate, eugenol, ethylene brassylate, eucalyptol, geranyl nitrile, geraniol, gamma undecalactone, hexyl cinnamic aldehyde, hydroxy citronellal, heliotropin, 1,3,4,6,7,8-hexahydro-4,6,6,7,8,8-hexamethylcyclopenta-gamma-2-benzopyrane, hexyl salicylate, isobornyl acetate, ionone gamma methyl, lavendin, D-limonene, linalyl acetate, methyl cedrenyl ketone, methyl dihydro jasmonate, methyl eugenol, methyl heptenone, methyl nonyl ketone, meta beta naphthyl ketone, 2-methyl-3-(para-isoprophylphenyl)-propionaldehyde, musk xylol, musk ketone, musk tibetine, nonane diol-1,3-aoetate, para-isopropyl-alpha-octyl hydrocinnamic aldehyde, para-tertiary butyl cyclohexyl acetate, patchouli, orange CP, ortho-tertiary butyl cyclohexyl acetate, phenyl ethyl alcohol, phenoxy ethyl iso butyrate, 4-terpinyl plentacyclo hexanone, terpinyl acetate, tetrahydro mugol, and trichloromethyl phenyl carbinyl acetate. In a preferred embodiment of the liquid and gel autodish compositions, a lemon scent is imparted by incorporation of a perfume composition. Perfumes which incorporate a lemon scent include: dipentene, ethyl citral, lemon aldehyde, litsea cubeba oil, lemonile, and D-limonenc. Preferred lemon perfumes do not drastically lower available chlorine levels and include dipentene, lemon aldehyde, litsea cubeba oil, and lemonile.

Other suitable perfumes add desirable "notes" and nuances to the lemon scent obtained from the above perfumes, and produce a more pleasing, "natural" lemon perfume composition. These "lemon-supplement" perfumes may impart any of a range of other scents, such as floral, pine, "green" or other, and include: Agrumate, Agrumenal, Agrunitrile, Agrusoft, Alcohol C-8, Alfol 8, allyl amyl glycolate, allyl cyclohexyl propionate, alpha pinene, alpine 2926, amyl cinnamic aldehyde, Bergamal, citrotone B, dipentene 122, elemi oil, ethyl aceto acetate, ethyl linalool, hexyl cinnamic aldehyde, isocyclo citral, isobornyl acetate, lemongrass oil, lime alcohol, lime oil terpeneless, lime oxide, limettal, linalool oxide, methyl heptenone, methyl nonyl ketone, myrac aldehyde, ocimene, ocimenol ocimenyl acetate, orange aldehyde, orange juice carbonyl, para cymene, and tetrahydro myrcenol. Preferred lemon-supplement perfumes include one or more of: alcohol, Alfol 8, citrotone B, lime alcohol, Lime oil terpeneless, lime oxide, and linalool oxide. Highly preferred lemon-supplement perfumes include: alcohol C-8, citrotone B, and lime alcohol. Other preferred perfumes from Example 5 include: 3-nonanone, Acetal S, Acetate C-9, Alcohol C-9, allyl cyclohexyl propionate, amyl benzoate, cyclo galbanate, decyl methyl ether, Folione, geranyl ethyl ether, greenyl acetate, iso propyl quinolene, linalyl propionate, methyl chavicol, methyl diphenyl ether, methyl octine carbonate, opopanax oil, paracresyl methyl ether, Peru balsam resin, phenyl ethyl butyrate and tetra hydro myrcenol. Thus, preferred perfume compositions imparting a lemon scent may incorporate any of these preferred lemon, lemon-supplement or other perfumes or mixtures thereof. It should be understood that liquid and gel compositions may incorporate, in their perfume compositions, one or more perfumes which may reduce available chlorine levels by large amounts. Such perfumes may be desirable to impart a particular scent to the autodish composition.

The amount of perfume composition employed in the cleaning composition is from 0.001 to 2% by weight of the cleaning composition. Alternatively, one may use from 0.005 to 1%, and more preferably 0.01 to 0.5%. There may be up to 200 different perfumes in perfume compositions, each present at 0.5-25% by weight of the perfume composition.

Liquid and gel autodish compositions may include a yellow colorant and a lemon perfume. Applicants have discovered that certain bleach-stable yellow colorants lose color when autodish compositions also include perfume. The autodish composition of Example 1 below loses color from Pigment Yellow 14, 74 and 109 when a perfume composition is added. However, when the colorant is Direct yellow 28, Pigment Yellow 108 or 155 or zinc chromate, no significant color loss occurs. Further colorants believed to be stable in the presence of bleach and perfume are Direct Yellow 29 and Direct Dye C. I. Number 19550. Therefore, a further embodiment of the present invention is a liquid or gel autodish composition including one or more lemon perfumes and one or more colorants selected from Direct Yellow 28, Direct Yellow 29, Direct Dye C. I. Number 19550, Pigment Yellow 108, pigment Yellow 155, and zinc chromate. The lemon perfume compositions of Example 6 below are suitable for the autodish embodiment in which color does not fade. A commercial perfume composition suitable for liquid and gel compositions in "Sundance 872941" ex Bush Boake Allen, Inc.

Minor amounts of various other adjuvants may be present in the cleaning composition. These include flow control agents (in granular forms), soil suspending agents, antiredeposition agents, anti-tarnish agents, enzymes (e.g., protease, amylase and/or lipase at 0.05-2% by weight, preferably 0.5-1.5%) and other functional additives. The pH of the cleaning composition may be adjusted by addition of strong acid or base.

GRANULAR COMPOSITIONS

The compositions of the invention are not restricted as to manner of preparation. The granular compositions can be prepared in any manner, including dry mixing, such as that described in U.S. Pat. No. 4,379,069 that results in formation of a granular product form. The process described in U.S. Pat. No. 2,895,916 issued July 21, 1959 to Milenkevich et al., and variations thereof, are particularly suitable. Also particularly suitable are the processes described in U.S. Pat. Nos. 4,427,417, issued Jan. 24, 1984 to Porasik; 3,609,088, issued Sept. 28, 1971 to Sumner; and 3,580,545, issued May 25, 1971 to O'Brien. All of the above patents are incorporated herein by reference.

LIQUID AND GEL COMPOSITIONS

Liquid compositions are disclosed in U.S. Pat. No. 4,116,851—Rupe et al. issued Sept. 26, 1978; U.S. Pat. No. 4,431,559—Ulrich, issued Feb. 14, 1984.; U.S. Pat. No. 4,511,487—pruhs et al., issued Apr. 16, 1985; U.S. Pat. No. 4,512,908—Heile, issued Apr. 23, 1985; Canadian Patent No. 1,031,229—Bush et al.; European Patent Application No. 0130678—Heile, published Jan. 9, 1985; European Patent Application 0176163—Robinson, published Apr. 2, 1986; U.K. Patent application GB No. 2,166,199A—Julemont et al., published Nov. 29, 1984; U.K. patent Application GB No. 2,163,447A—Colaruso, published Feb. 26, 1986; and U.K. Patent application GB No. 2,164,350A—Lai et al., published Mar. 19, 1986. All of said patents and said published applications are incorporated herein by reference.

The following Examples illustrate various embodiments of the invention.

EXAMPLE 1

Colorants are screened in the following liquid autodish formula for bleach stability.

| Ingredient | % |
|---|---|
| Bentonite Clay | 3.0 |
| Sodium Hydroxide | 1.2 |
| Monostearyl Acid Phosphate | 0.16 |
| Sodium Silicate (2.4r) | 8.00 |
| Sodium Carbonate | 8.50 |
| Sodium Tripolyphosphate Hexahydrate | 12.00 |
| Sodium Tripolyphosphate Anhydrous | 12.00 |
| Sodium Hypochlorite | 1.00 |
| Dowfax 2A-1 | 0.36 |
| Colorant, post-dosed | 0.006 |
| Water | to 100% |

The above ingredients are added in the order listed to the water in a mixing vessel. Twenty-four 100 ml samples are dispensed into separate jars and one of the 24 colorants listed below is added. (Direct Yellow 28 is added as a 2-3% solution which has been slightly heated to avoid clumping or precipitation of the colorant.) The formulations are then stored at 120° F. and examined for color and fading for up to one week. The sample test is discontinued when it fades.

| Colorant | C.I. No. | Structure | Bleach Stability |
|---|---|---|---|
| Pigment Yellow 49 | 11765 | Monoazo | No |
| Pigment Yellow 74 | 11741 | Monoazo | Yes |
| Pigment Yellow 83 | 21108 | Disazo | No |
| Pigment Yellow 109 | NA | — | Yes |
| Pigment Yellow 128 | NA | — | No |
| Direct Yellow 28 | 19555 | Monoazo | Yes |
| D&C Yellow #10 | NA | — | No |
| Pigment Yellow 63 | 21091 | Disazo | No |
| Pigment Yellow 36 | 77955 | Inorganic | No |
| Disperse Yellow 3 | 11855 | Monoazo | No |
| Acid Yellow 73 | 45350 | Xanthene | No |
| D&C Yellow 7 | 45350 | Xanthene | No |
| Pigment Yellow 173 | NA | — | No |
| Pigment Yellow 155 | NA | — | Yes |
| Reactive Yellow 25 | NA | — | No |
| Pigment Yellow 108 | 68420 | Anthraquinone | Yes |
| Pigment Yellow 14 | 21095 | Disazo | Yes |
| Pigment Yellow 1 | 11680 | Monoazo | No |
| Acid Yellow 4 | 18695 | Monoazo | No |
| Zinc Chromate $ZnO.CrO_3$ some $K_2O$ | 77955 | Inorganic | Yes |
| Zinc Chromate | 77955 | Inorganic | No |

-continued

| Colorant | C.I. No. | Structure | Bleach Stability |
|---|---|---|---|
| 4 $ZnO.K_2O.4\ CrO_3.3\ H_2O$ | | | |

These results indicate that the following dyes are compatible with the bleaching cleaning composition: Pigment Yellows 14, 74, 108, 109 and 155; Direct Yellow 28; and zinc chromate.

EXAMPLE 2 the liquid automatic dishwasher formula formulation given below is prepared using Direct Yellow 28 and Pigment Yellow 74; formula without dye is used as a control.

| Ingredient | % |
|---|---|
| Bentonite Clay (Polargel T) | 2.0 |
| Aluminum Stearate | 0.12 |
| Sodium Hydroxide | 1.4 |
| Monostearyl Acid Phosphate | 0.16 |
| Sodium Silicate | 15.0 |
| Sodium Carbonate | 6.0 |
| Sodium Tripolyphosphate | 16.0 |
| Sodium Hypochlorite | 1.0 |
| Perfume | 0.10 |
| Dye - Direct Yellow 28 or | 0.006 |
| Pigment Yellow 74 | 0.0125 |
| Water | to 100% |

Samples of each of the formulas are placed in storage at room temperature. The samples are tested after three months for color stability.

In color determination, approximately 32.5 grams of detergent is weighed into Falcon 1007, 60×15 mm polystyrene, Petri dishes. For initial color values, 8 readings are taken of each sample; the averaged values appear below. Four readings are taken per sample at each of L, a and B after three months. Color measurements, specifically L, a, b values, are recorded for the filled Petri dishes while using a white backing plate by a Colorgard System/05 (Gardner #1163) colorimeter. L-Values, a-values, and b-values represent whiteness, redness/greenness, and yellowness/blueness, respectively; b-values best indicate colorant stability. After the initial readings are taken, the samples are returned from the Petri dishes to their storage bottles.

| | | Initial | After Three Months |
|---|---|---|---|
| Undyed Control | L | 80.8 | 78.7 |
| | a | 0.3 | 0.7 |
| | b | 9.0 | 9.3 |
| Direct Yellow 28 | L | 78.3 | 77.7 |
| | a | −1.2 | −1.0 |
| | b | 26.1 | 23.2 |
| Pigment Yellow 74 | L | 79.2 | 78.5 |
| | a | −2.8 | 0.7 |
| | b | 25.7 | 10.2 |

The formula with Direct Yellow 28 showed no significant change in L, a, and b values after three months and insignificant change for the undyed control. On the other hand, the formula with Pigment Yellow 74 faded rapidly and became comparable to the control in appearance. Thus, Direct Yellow 28 better maintains color over time in the cleaning composition than Pigment Yellow 74.

EXAMPLE 3

Direct Yellow 28 is used in the following agglomerated ADD formulations.

| Ingredient | % |
|---|---|
| Nonionic Surfactant | 2.7 |
| Sodium Tripolyphosphate | 24.0 |
| Sodium Carbonate | 35.0 |
| Sodium Silicate, 2.4r | 8.4 |
| Sodium Sulfate | 16.934 |
| Direct Yellow 28 | 0.016 |
| Sodium Dichloroisocyanurate Dihydrate | 1.75 |
| Perfume | 0.20 |
| Water | 11.0 |

Samples are stored for three weeks at room temperature, 35° F., 80° F./80% relative humidity, and 105° F. L, a and b values, averaged over four readings, are measured as in Example 2. These readings are compared with the initial readings below.

| | | Initial (72° F.) | 72° F. | 35° F. | 80° F. | 105° F. |
|---|---|---|---|---|---|---|
| Powder | L | 85.0 | 85.0 | 84.6 | 85.0 | 85.3 |
| ADD | a | −2.2 | 0.1 | 0.3 | 0.0 | 0.2 |
| | b | 27.0 | 27.1 | 27.6 | 26.6 | 26.7 |

Thus, Direct Yellow 28 also imparts stable yellow color to the granular cleaning composition, even under harsh temperature conditions.

EXAMPLE 4

The following clear el formulations are prepared:

| | A | B | C |
|---|---|---|---|
| Sodium Tripolyphosphate | 15.0 | — | — |
| Potassium Pyrophosphate | — | 13.5 | 13.5 |
| Potassium Carbonate | 7.0 | 7.0 | 7.0 |
| Sodium Silicate (2.4r) | 3.0 | — | 3.0 |
| Potassium Silicate (2.1r) | — | 3.12 | — |
| Carbopol 940 | 1.3 | 1.3 | 1.3 |
| Dowfax 2A-1 | 0.9 | 0.9 | 0.9 |
| Antifoam DB-100 | 0.1 | 0.1 | 0.1 |
| Sodium Hydroxide | 1.0 | — | 1.0 |
| Potassim Hydroxide | — | 1.4 | — |
| Sodium Hypochlorite | 0.9 | 1.0 | 1.0 |
| Direct Yellow 28 | 0.004 | 0.004 | 0.004 |
| Perfume | 0.10 | 0.1 | 0.1 |
| Water | | to 100% | |

L, a, and b values are measured and averaged over four readings as in Example 2. Samples are stored at room temperature for six weeks. The six week values are compared with initial values below.

| | | Initial | Six Weeks 72° F. |
|---|---|---|---|
| Sample A | L | 61.8 | 57.3 |
| | a | −3.6 | −2.4 |
| | b | 31.5 | 29.6 |
| Sample B | L | 56.3 | 69.3 |
| | a | −1.7 | −5.3 |
| | b | 26.8 | 26.4 |
| Sample C | L | 59.5 | 65.0 |
| | a | −1.2 | −4.1 |
| | b | 29.7 | 32.6 |

No significant differences in b value, which measures yellow/blue, is seen. Thus, direct Yellow 28 imparts stable color to a variety of different gel autodish formulations.

EXAMPLE 5

The perfumes listed below are screened for compatibility with chlorine bleach. This is done by measuring active chlorine after storage of liquid autodish composition of Example 1. In the screening test, a large batch of liquid autodish composition is made.

Three samples of autodish composition having perfume at 0.10% are made. One sample, stored at room temperature for up to 4 weeks, has available chlorine measured after 1 and 4 weeks. Results appear in columns A and B below. A second and third sample are stored at 120 and 105 degrees Fahrenheit for 1 and 4 weeks respectively. The available chlorine measurements for these samples appears in columns C and D below. The values in columns A–D indicate the percentage of available chlorine remaining in the autodish composition after storage with perfume, expressed as a percentage of the total available chlorine available theoretically in the initial autodish composition.

Available chlorine may be determined iodometrically as by the procedure described in Kolthoff and Sandell, *Textbook of Quantitative Inorganic Analysis*, Macmillan Company, 1947, p. 626. This procedure may be modified to prevent surfactant from interfering in the titration as follows: Weigh a 15 g sample into a 500 ml iodine flask. Add 20 ml 15% KI solution. Add 80 ml distilled water. Stir to dissolve. Add 80 ml 1 to 1 of chloroform-acetic acid solution and begin titration to a light straw color. Add 5 ml starch and titrate to disappearance of blue color. Available chlorine is then calculated.

| | PERFUME (0.10%) | CHEMICAL STRUCTURE | SUPPLIER | A 72° F. 1 wk | B 72° F. 4 wk | C 120° F. 1 wk | D 105° F. 4 wk |
|---|---|---|---|---|---|---|---|
| 1 | 3-NONANONE | KETONE | GIVAUDAN | 79 | 77 | 40 | 25 |
| 2 | ACETAL CD | MIXED ACETAL | GIVAUDAN | 100 | 96 | 38 | 3 |
| 3 | ACETAL S | MIXED ACETAL | GIVAUDAN | 100 | 99 | 46 | 6 |
| 4 | ACETATE C-9 | ESTER | GIVAUDAN | 100 | 97 | 44 | 5 |
| 5 | ACETOPHENONE | KETONE | GIVAUDAN | 82 | 82 | 45 | 8 |
| 6 | AD-23B87/1 | PROPRIETARY | LEVER | 83 | 66 | | |
| 7 | AD-27B87/1 | PROPRIETARY | LEVER | 84 | 68 | | |
| 8 | ADOXAL | ALDEHYDE | GIVAUDAN | 81 | 71 | 29 | 3 |
| 10 | AGRUMATE | PROPRIETARY | DRAGOCO | 99 | 91 | 36 | 7 |
| 12 | AGRUNITRILE | PROPRIETARY | DRAGOCO | 99 | 65 | 17 | 6 |
| 13 | AGRUSOFT | PROPRIETARY | H&R | 87 | 79 | 22 | 3 |
| 14 | ALCOHOL C-8 | ALCOHOL | GIVAUDAN | 98 | 97 | 36 | 73 |
| 15 | ALCOHOL C-9 | ALCOHOL | GIVAUDAN | 95 | 35 | 36 | 2 |
| 16 | ALDEHYDE C-14 | LACTONE | GIVAUDAN | 98 | 94 | 41 | 5 |
| 17 | ALFOL 8 | ALCOHOL | VISTA | 100 | 97 | 93 | 11 |
| 18 | ALLYL AMYL GLYCOLATE ALLYL | ESTER | IFF | 98 | 94 | 29 | 3 |
| 19 | ALLYL CYCLOHEXYL PROPIONATE | ESTER | GIVAUDAN | 100 | 94 | 43 | 4 |
| 20 | ALPHA PINENE | TERPENE | MANH. | 98 | 96 | 25 | 2 |
| 21 | ALPINE 2926 | PROPRIETARY | ALPINE | 100 | 95 | 41 | 5 |
| 22 | AMBROXAN 50% DPG | MIXTURE | HENKEL | 97 | 96 | 46 | 5 |
| 23 | AMYL BENZOATE | ESTER | GIVAUDAN | 100 | 97 | 41 | 6 |
| 24 | AMYL CINNAMIC ALDEHYDE | ALDEHYDE | CHEM FLEUR | 92 | 90 | 35 | 4 |
| 25 | AMYL PROPIONATE | ESTER | GIVAUDAN | 100 | 97 | 35 | 6 |
| 26 | AMYL SALICYLATE | ESTER | I.F.F. | 86 | 80 | 24 | 1 |
| 27 | AMYRIS OIL | ESSEN OIL | J.P.M. | 92 | 84 | 22 | 2 |
| 28 | BERGAMAL | ALDEHYDE | I.F.F. | 85 | 79 | 31 | .3 |
| 29 | BERGAMOT 147 GIVCO | PROPRIETARY | GIVAUDAN | 91 | 82 | 31 | 6 |
| 30 | BERGAMOT 315 | PROPRIETARY | LEVER | 96 | 85 | 37 | 6 |
| 31 | CITRAL | ALDEHYDE | FRITZ. | 65 | 60 | 21 | 1 |
| 32 | CITRO-BLEACH B | PROPRIETARY | SOZIO | 80 | 78 | 38 | 36 |
| 33 | CITROTONE B | PROPRIETARY | I.F.F | 98 | 96 | 33 | 5 |
| 34 | CORPS 1490 0.1% DPG | PROPRIETARY | A.C. | 98 | 98 | 38 | 5 |
| 35 | CYCLACET | ESTER | I.F.F. | 90 | 84 | 35 | 6 |
| 36 | CYCLO GALBANATE | ESTER | DRAGOCO | 93 | 87 | 40 | 2 |
| 37 | D.E.P. | ESTER | R.P. | 98 | 96 | 36 | 7 |
| 38 | DECYL METHYL ETHER | ETHER | I.F.F. | 99 | 97 | 48 | 9 |
| 39 | DIHYDRO ROSE OXIDE | ETHER | BED. | 97 | 97 | 44 | 9 |
| 40 | DIPENTENE 122 | TERPENES | POLAROME | 89 | 84 | 41 | 3 |
| 41 | E-5204/2 | PROPRIETARY | LEVER | 97 | 95 | 49 | 1 |
| 42 | E-5204/3 | PROPRIETARY | LEVER | 94 | 90 | 48 | .2 |
| 43 | ELEMI OIL | ESSEN OIL | A.C. | 90 | 86 | 42 | 4 |
| 44 | ETHYL ACETO ACETATE | ESTER | I.F.F. | 93 | 82 | 33 | 3 |
| 45 | ETHYL AMYL KETONE | KETONE | GIVAUDAN | 85 | 86 | 43 | 3 |
| 46 | ETHYL CITRAL | ALDEHYDE | GIVAUDAN | 76 | 70 | 34 | .2 |
| 47 | ETHYL LINALOOL | ALCOHOL | GIVAUDAN | 90 | 86 | 39 | 1 |
| 48 | ETHYL SALICYLATE | ESTER | GIVAUDAN | 82 | 77 | 40 | 5 |
| 49 | EUGENOL | ALCOHOL | CHARABOT | 82 | 76 | 41 | 6 |
| 50 | FENYRANE | PROPRIETARY | NAARDEN | 93 | 87 | 44 | 7 |
| 51 | FOLIONE | ESTER | GIVAUDAN | 95 | 97 | 47 | 8 |
| 52 | FRESH LINEN | PROPRIETARY | GIVAUDAN | 94 | 90 | 45 | 7 |
| 53 | GALBEX | PROPRIETARY | FIRM. | 94 | 86 | 37 | 7 |
| 54 | GERANIOL CRUDE | ALCOHOL | I.F.F. | 89 | 79 | 44 | 5 |
| 55 | GERANIUM IMPERIAL | PROPRIETARY | FLORASYNTH | 96 | 92 | 31 | 4 |
| 56 | GERANYL ACETONE | KETONE | GIVAUDAN | 80 | 75 | 30 | 3 |
| 57 | GERANYL ETHYL ETHER | ETHER | I.F.F. | 95 | 88 | 43 | 4 |
| 58 | GERANYL NITRILE | NITRILE | GIVAUDAN | 85 | 73 | 29 | 2 |
| 59 | GINGERALE P GIVCO | PROPRIETARY | GIVAUDAN | 86 | 73 | 38 | 4 |
| 60 | GREENOXANE | PROPRIETARY | NAARDEN | 96 | 96 | 55 | 12 |

-continued

| | PERFUME (0.10%) | CHEMICAL STRUCTURE | SUPPLIER | A 72° F. 1 wk | B 72° F. 4 wk | C 120° F. 1 wk | D 105° F. 4 wk |
|---|---|---|---|---|---|---|---|
| 61 | GREENTONE | PROPRIETARY | DRAGOCO | 91 | 86 | 56 | 11 |
| 62 | GREENYL ACETATE | ESTER | DRAGOCO | 92 | 86 | 53 | 12 |
| 63 | HESPERIDYL | PROPRIETARY | GIVAUDAN | 90 | 85 | 53 | 9 |
| 64 | HEXYL CINNAMIC ALDEHYDE | ALDEHYDE | I.F.F. | 96 | 95 | 40 | 8 |
| 65 | HEXYL NEO PENTANOATE | ESTER | ALPINE | 100 | 98 | 43 | 9 |
| 66 | ISO BORNYL ACETATE | ESTER | GIVAUDAN | 98 | 98 | 51 | 9 |
| 67 | ISO CYCLO CITRAL | ALDEHYDE | I.F.F. | 74 | 69 | 45 | 13 |
| 68 | ISO CYCLO GERANIOL | ALCOHOL | I.F.F. | 87 | 93 | 40 | 2 |
| 69 | ISO E SUPER | PROPRIETARY | I.F.F. | 87 | 73 | 24 | 1 |
| 70 | ISO PROPYL QUINOLENE | QUINOLENE | GIVAUDAN | 98 | 92 | 41 | 3 |
| 71 | ISOBORNYL PROPIONATE | ESTER | GIVAUDAN | 99 | 97 | 66 | 19 |
| 72 | LAVANDEX | PROPRIETARY | S.C.M. | 87 | 23 | 38 | 4 |
| 73 | LAVANDULOL | PROPRIETARY | I.F.F. | 85 | 70 | 43 | 6 |
| 74 | LAVENDER FIXOAP | PROPRIETARY | CHARABOT | 87 | 82 | 38 | 2 |
| 75 | LAVENDER KETONE | PROPRIETARY | I.F.F. | 84 | 76 | 46 | 9 |
| 76 | LEAF ALCOHOL | ALCOHOL | GIVAUDAN | 83 | 69 | 28 | .4 |
| 77 | LEMCORE E | PROPRIETARY | DE LAIRE | 90 | 90 | 49 | 31 |
| 78 | LEMCORE E-2 | PROPRIETARY | DE LAIRE | 93 | 95 | 47 | 46 |
| 79 | LEMON ALDEHYDE | ALDEHYDE | IVOLIN | 73 | 66 | 29 | 1 |
| 80 | LEMONAD | PROPRIETARY | DRAGOCO | 95 | 90 | 45 | 11 |
| 81 | LEMONGRASS OIL (GUAT) | ESSEN OIL | POLAROME | 64 | 54 | 25 | 16 |
| 82 | LEMONILE | NITRILE | GIVAUDAN | 81 | 66 | 28 | 27 |
| 83 | LIFFRAROME | PROPRIETARY | I.F.F. | 83 | 68 | 26 | 4 |
| 84 | LILIAL | ALDEHYDE | GIVAUDAN | 69 | 65 | 41 | 35 |
| 85 | LIME ALCOHOL | ALCOHOL | POLAROME | 95 | 93 | 50 | 9 |
| 86 | LIME OIL T'LESS | ESSEN OIL | POLAROME | 76 | 94 | 29 | 26 |
| 87 | LIME OXIDE | ETHER | GIVAUDAN | 86 | 71 | 50 | 13 |
| 88 | LIMETTAL | PROPRIETARY | NAARDEN | 86 | 74 | 39 | 30 |
| 89 | LINALOOL OXIDE | ETHER | GIVAUDAN | 95 | 93 | 44 | 48 |
| 90 | LINALYL FORMATE | ESTER | GIVAUDAN | 84 | 78 | 67 | 40 |
| 91 | LINALYL PROPIONATE | ESTER | GIVAUDAN | 90 | 82 | 47 | 37 |
| 92 | LITSEA CUBEBA OIL | ESSEN OIL | AROMA R. | 74 | 72 | 39 | 34 |
| 93 | LRG-1135 | PROPRIETARY | R.B.D. | 85 | 74 | 27 | 31 |
| 94 | LYRAL | ALDEHYDE | TAKASAGO | 66 | 30 | 42 | 1 |
| 95 | LYSIA | PROPRIETARY | FIRM. | 83 | 77 | 42 | 50 |
| 96 | M.I.C.H.A | ESTER | I.F.F. | 99 | 91 | 37 | 41 |
| 97 | MAGNOLYS SA | PROPRIETARY | FIRM. | 87 | 78 | 38 | 38 |
| 98 | MANDARIN ALDEHYDE | PROPRIETARY | FIRM. | 100 | 87 | 40 | 57 |
| 99 | MANDARIN OLIFFAC | PROPRIETARY | IFF | 95 | 58 | 16 | 24 |
| 100 | MELONADE | PROPRIETARY | TOMBAREL | 100 | 87 | 53 | 50 |
| 101 | MELONIA | PROPRIETARY | GIVAUDAN | 84 | 84 | 44 | 43 |
| 102 | MENTHONE RACEMIC | KETONE | BERJE | 49 | 43 | 12 | 11 |
| 103 | METHOXY CINNAMAL | ALDEHYDE | N.M. | 88 | 95 | 38 | 40 |
| 104 | METHOXY PHENYL BUTENONE | ESTER | I.F.F. | 81 | 76 | 42 | 40 |
| 105 | METHTYL JASMONATE | ESTER | FIRM. | 67 | 61 | 13 | 18 |
| 106 | METHYL AMYL KETONE | KETONE | GIVAUDAN | 70 | 67 | 36 | 30 |
| 107 | METHYL CEDRYL KETONE | KETONE | A.R. | 88 | 76 | 35 | 51 |
| 108 | METHYL CHAVICOL | ALCOHOL | I.F.F. | 95 | 96 | 46 | 51 |
| 109 | METHYL CYCLO CITRONE | KETONE | FIRM. | 67 | 51 | 13 | 22 |
| 110 | METHYL DIPHENYL ETHER | ETHER | I.F.F. | 96 | 92 | 80 | 67 |
| 111 | METHYL EUGENOL | ALCOHOL | GIVAUDAN | 95 | 95 | 36 | 38 |
| 112 | METHYL HEPTENONE | KETONE | GIVAUDAN | 59 | 48 | 18 | 24 |
| 113 | METHYL HEXYL KETONE | KETONE | ELAN | 80 | 80 | 34 | 60 |
| 114 | METHYL IONONE ALPHA | KETONE | I.F.F. | 80 | 63 | 28 | 27 |
| 115 | METHYL ISO EUGENOL | ALCOHOL | GIVAUDAN | 84 | 85 | 31 | 37 |
| 116 | METHYL NONYL KETONE | KETONE | GIVAUDAN | 75 | 76 | 46 | 35 |
| 117 | METHYL OCTINE CARBONATE | ESTER | GIVAUDAN | 94 | 90 | 40 | 37 |
| 118 | METHYL PENTENOL | ALCOHOL | GIVAUDAN | 77 | 67 | 9 | 17 |
| 119 | MOUSSE DE METRA | PROPRIETARY | FLORASYNTH | 79 | 76 | 19 | 30 |
| 120 | MUGUOL | ALCOHOL | I.F.F. | 56 | 43 | 20 | 14 |
| 121 | MUSK 21 | PROPRIETARY | I.F.F. | 98 | 88 | 26 | 42 |
| 122 | MUSK 21-A | PROPRIETARY | I.F.F. | 99 | 89 | 42 | 38 |
| 123 | MUSK KETONE 50% DPG | MIXTURE | GIVAUDAN | 93 | 91 | 26 | 45 |
| 124 | MYRAC ALDEHYDE | ALDEHYDE | I.F.F. | 78 | 43 | 33 | 37 |
| 125 | MYRALDENE | PROPRIETARY | I.F.F | 47 | 31 | 6 | 1 |
| 126 | MYRALDYL ACETATE | ESTER | GIVAUDAN | 53 | 54 | 18 | 41 |
| 127 | MYRALIDE | PROPRIETARY | DRAGOCO | 93 | 82 | 41 | 35 |
| 128 | MYRCENYL ACETATE | ESTER | I.F.F. | 89 | 49 | 45 | 38 |
| 129 | MYRRH OIL | NATURAL | CHARABOT | 78 | 67 | 33 | 47 |
| 130 | NECTAROL | PROPRIETARY | FIRM | 91 | 80 | 40 | 39 |
| 131 | NECTILYS | PROPRIETARY | GIVAUDAN | 82 | 88 | 51 | 36 |
| 132 | NEO FOLIONE | ESTER | GIVAUDAN | 97 | 86 | 4 | 4 |
| 133 | NEO LAVANDATE | PROPRIETARY | NAARDEN | 83 | 78 | 42 | 31 |
| 134 | NEOBERGAMATE FORTE | ESTER | NAARDEN | 79 | 72 | 26 | 30 |
| 135 | NERGER FORMATE | ESTER | I.F.F. | 72 | 65 | 22 | 21 |
| 136 | NEROL 800 | ALCOHOL | U.C. | 79 | 71 | 36 | 23 |
| 137 | NEROL GD | ALCOHOL | GIVAUDAN | 79 | 69 | 31 | 0 |
| 138 | NEROLI BIGARADE | ESSEN OIL | UNGERER | 77 | 70 | 25 | 28 |
| 139 | NEROLI OLIFFAC | PROPRIETARY | I.F.F. | 78 | 72 | 17 | 27 |

-continued

| | PERFUME (0.10%) | CHEMICAL STRUCTURE | SUPPLIER | A 72° F. 1 wk | B 72° F. 4 wk | C 120° F. 1 wk | D 105° F. 4 wk |
|---|---|---|---|---|---|---|---|
| 140 | NERONE NP | KETONE | GIVAUDAN | 83 | 78 | 40 | 24 |
| 141 | NERYL ACETATE | ESTER | GIVAUDAN | 75 | 69 | 29 | 32 |
| 142 | NETTLE FRAG. | PROPRIETARY | B.B.A. | 78 | 74 | 34 | 28 |
| 143 | NOPYL FORMATE | ESTER | A.A. | 90 | 54 | 21 | 9 |
| 144 | NUTMEG OIL 800 | ESSEN OIL | S.C.M. | 72 | 65 | 34 | 26 |
| 145 | OAKMOSS SOL. RESIN | PROPRIETARY | GIVAUDAN | 83 | 80 | 40 | 35 |
| 146 | OCIMENE | TERPENE | I.F.F. | 74 | 60 | 69 | 23 |
| 147 | OCIMENOL | ALCOHOL | I.F.F. | 81 | 74 | 35 | 43 |
| 148 | OCIMENYL ACETATE | ESTER | I.F.F. | 79 | 69 | 31 | 30 |
| 149 | OCTANOL NITRILE | NITRILE | N.M. | 91 | 87 | 44 | 25 |
| 150 | OCTYL ISOBUTYRATE | ESTER | FIRM | 98 | 97 | 50 | 56 |
| 151 | OEILLET | PROPRIETARY | FIRM | 72 | 67 | 42 | 47 |
| 152 | OENANTHIC ETHER | ETHER | ELAN | 90 | 92 | 43 | 55 |
| 153 | OLIBANUM OIL | NATURAL | CHARABOT | 71 | 62 | 20 | 26 |
| 154 | OMBERTOL | PROPRIETARY | GIVAUDAN | 92 | 90 | 29 | 43 |
| 155 | ONCICTAL | ALDEHYDE | DRAGOCO | 53 | 42 | 46 | 35 |
| 156 | OPOPANAX OIL | NATURAL | C.M.A. | 92 | 90 | 52 | 47 |
| 157 | ORANGE ALDEHYDE | ALDEHYDE | I.F.F. | 73 | 64 | 37 | 33 |
| 158 | ORANGE JUICE CARBONYL 12 | PROPRIETARY | GIVAUDAN | 79 | 71 | 47 | 40 |
| 159 | ORIVONE | KETONE | I.F.F. | 77 | 76 | 36 | 50 |
| 160 | OSMANTINIA | PROPRIETARY | GIVAUDAN | 89 | 81 | 51 | 66 |
| 161 | OTTONEA | PROPRIETARY | DRAGOCO | 95 | 90 | 20 | 42 |
| 162 | OXALIDE T | PROPRIETARY | TAKASAGO | 43 | 88 | 46 | 35 |
| 163 | OXANATE ISOBORNYL | ESTER | A.C. | 91 | 90 | 52 | 62 |
| 164 | OXYOCTALINE FORMATE | ESTER | GIVAUDAN | 86 | 91 | 18 | 37 |
| 165 | OZATONE | PROPRIETARY | B.B.A. | 87 | 87 | 42 | 39 |
| 166 | OZONIL | PROPRIETARY | H&R | 91 | 84 | 37 | 30 |
| 167 | OZONILE | PROPRIETARY | H&R | | | | |
| 168 | P-C-ISO BUTYRATE | ESTER | I.F.F. | 87 | 65 | 35 | 19 |
| 169 | P-ISO-PROPYL | ALDEHYDE | I.F.F. | 78 | 72 | 48 | 38 |
| 170 | P-METHYL BENZALDEHYD | ALDEHYDE | GIVAUDAN | 84 | 85 | 64 | 50 |
| 171 | P-METHYL QUINOLENE | QUINOLENE | I.F.F. | 91 | 88 | 28 | 43 |
| 172 | P-T-ACETALDEHYDE | ALDEHYDE | GIVAUDAN | 77 | 81 | 59 | 45 |
| 173 | PALMANITRILE | NITRILE | DRAGOCO | 95 | 56 | 18 | .7 |
| 174 | PAMPLEMOUSSE | PROPRIETARY | FIRM | 86 | 75 | 46 | 38 |
| 175 | PARA CYMENE | TERPENE | GIVAUDAN | 98 | 95 | 43 | .7 |
| 176 | PARACRESYL METHYL ETHER | ETHER | GIVAUDAN | 98 | 98 | 47 | 4 |
| 177 | PARMANTHEME | PROPRIETARY | FIRM | 76 | 72 | 40 | 26 |
| 178 | PEACH ALDEHYDE | ALDEHYDE | I.F.F. | 90 | 82 | 35 | 36 |
| 179 | PEPPERMINT OIL | ESSEN OIL | CALISON | 77 | 77 | 41 | 27 |
| 180 | PERSICOL | PROPRIETARY | FIRM | 92 | 86 | 43 | 52 |
| 181 | PERU BALSAM RESIN | NATURAL | GIVAUDAN | 96 | 83 | 56 | 51 |
| 182 | PHANTOLID | PROPRIETARY | P.F.W. | 81 | 79 | 45 | 42 |
| 183 | PHENYL ETHYL ALCOHOL | ALCOHOL | I.F.F. | 91 | 83 | 55 | 41 |
| 184 | PHENYL ETHYL BUTYRATE | ESTER | GIVAUDAN | 97 | 84 | 57 | 48 |
| 185 | PHENYRAL | PROPRIETARY | I.F.F. | 80 | 88 | 47 | 49 |
| 186 | PHRONIS 8502 | PROPRIETARY | GIVAUDAN | 82 | 85 | 50 | 33 |
| 187 | PICONIA | PROPRIETARY | I.F.F. | 78 | 86 | 42 | 41 |
| 188 | STYRALLYL ALCOHOL | ALCOHOL | GIVAUDAN | 95 | 88 | 45 | 1 |
| 189 | TETRA HYDRO MYRCENOL | ALCOHOL | I.F.F. | 96 | 96 | 48 | — |
| 190 | VERTENEX | ESTER | CHEM FLEUR | 97 | 93 | 40 | 1 |

The above results indicate the following perfumes do not drastically reduce available chlorine and so are suitable for use in the cleaning composition: Agrumate, Agrunitrile, Agrusoft, Alcohol C 8, Alfol 8, allyl amyl glycolate, allyl cyclohexyl propionate, alpha pinene, Alpine 2926, amyl cinnamic aldehyde, Bergamal, citrotone B, dipentene 122, elemi oil, ethyl aceto acetate, ethyl linalool, geraniol crude, hexyl cinnamic aldehyde, isocyclo citral, lemon grass oil, lime alcohol, lime oil terpeneless, lime oxide, limettal, linalool oxide, methyl heptenone, methyl nonyl ketone, myrac aldehyde, ocimene, ocimenyl acetate, orange aldehyde, orange juice carbonyl, para cymene, and tetrahydro myrcenol. Suitable perfumes, which impart a lemon scent, include: dipentene, lemon aldehyde, litsea cubeba oil, and lemonile. Lemon-supplement perfumes, ie those which add nuance to a lemon scent, suitable for use in the cleaning composition include: Alcohol C-8, Alfol 8, citrotone B, lime alcohol, Lime oil terpeneless, lime oxide, and linalool oxide. Preferred perfumes include: 3-nonanone, Acetal S, Acetate C-9, Alcohol C-9, allyl cyclohexyl propionate, amyl benzoate, cyclo galbanate, decyl methyl ether, Folione, geranyl ethyl ether, greenyl acetate, iso propyl quinolene, linalyl propionate, methyl chavicol, methyl diphenyl ether, methyl octine carbonate, opopanax oil, paracresyl methyl ether, Peru balsam resin, phenyl ethyl butyrate and tetra hydro myrcenol.

EXAMPLE 6

Various perfume compositions, A, B, C, D, and E, are added to the liquid autodish composition of Example 1. Measurements of available chlorine and cleaning composition color after 1 and 4 weeks at room temperature show that no significant color loss occurs and, while available chlorine falls in all the compositions, substantial amounts of chlorine bleach activity remain. (All percentages are percent by weight of the perfume composition.)

| PERFUME COMPOSITION A | |
|---|---|
| Phenyl ethyl butyrate | 2.9 |

-continued

| | |
|---|---|
| 3-nonanone | 2.7 |
| Alcohol C-8 | 10.9 |
| Isopropyl quinolene | 0.6 |
| Alfol 8 | 18.2 |
| Lyral | 7.2 |
| Elemi Oil | 7.5 |
| Linalool Oxide | 2.2 |
| Eugenol | 2.0 |
| Bergamal | 10.0 |
| Geranyl nitrile | 2.0 |
| Lemonile | 16.7 |
| Leaf Alcohol | 1.1 |
| Phenyl Ethyl Alcohol | 16.0 |
| PERFUME COMPOSITION B | |
| Menthone racemic | 0.5 |
| 3-nonanone | 0.5 |
| Methyl heptenone | 2.0 |
| Oncictal | 0.5 |
| Opopanax oil | 2.5 |
| Verdyl acetate | 2.0 |
| Dimetol | 30.0 |
| Dipentene 122 | 60.0 |
| Galaxolide 50 | 2.0 |
| PERFUME COMPOSITION C | |
| Dimetol | 20.0 |
| Isobornyl acetate | 10.0 |
| Eugenol | 2.0 |
| Tetrahydro muguol | 20.0 |
| Citral | 2.0 |
| Orange juice carbonyl | 1.0 |
| Galaxolide 50 | 20.0 |
| Hexyl cinnamic aldehyde | 3.0 |
| Lime alcohol | 1.0 |
| Lime oxide | 20.0 |
| PERFUME COMPOSITION D | |
| Allyl trimethyl hexanone | 5.1 |
| Citronellol | 10.2 |
| Dimyrcetol (Dihydromyrcenol/ 2,6-dimethyl-7-octen-2-ol) | 6.1 |
| Dipentene 122 | 10.2 |
| Galoxolide 50 | 3.1 |
| Geranyl nitrile | 5.1 |
| Hexyl cinnamic aldehyde | 8.2 |
| Isobornyl acetate | 3.0 |
| Lemon terpenes | 5.1 |
| Lime alcohol | 2.0 |
| LIme terpenes | 20.4 |
| Methyl heptenone | 2.0 |
| Methyl nonyl ketone | 1.0 |
| Orivone (4-tertiary pentacyclo hexanone) | 1.0 |
| Terpinyl acetate extra | 10.0 |
| Tetrahydro muguol | 6.1 |
| 6-acetyl-1,1,3,4,4,6-hexamethyl tetrahydronaphthalene | 1.0 |
| PERFUME COMPOSITION E | |
| Allyl cyclohexyl propionate | 4.0 |
| Citronellal | 21.7 |
| Myrcenyl acetate | 6.1 |
| Crude geraniol | 11.0 |
| Hexyl cinnamic aldehyde | 1.5 |
| Isobornyl propionate | 8.7 |
| Lemon aldehyde | 1.0 |
| Limeoil terpeneless | 16.14 |
| Methyl eugenol | 5.4 |
| Methyl heptenone | 2.0 |
| Methyl nonyl ketone | 0.66 |
| Peru balsam resin | 1.5 |
| Tetra hydro myrcenol | 17.3 |
| Tonalid | 3.0 |

Foregoing Examples 1-demonstrate the utility of Direct Yellow 28 in a variety of automatic dishwasher detergent products, and its stability in the presence of chlorine bleach and perfume.

WHAT IS CLAIMED IS:

1. A cleaning composition comprising:

a) chlorine bleach is an amount providing 0.01-5% available chlorine to the composition; and b) 0.0005-0.2% of a relatively water-soluble or water-dispersible colorant which is color stable to chlorine bleach, which colorant is selected from the group consisting of Pigment Yellow 14, Pigment Yellow 74, Pigment Yellow 108, Pigment Yellow 109, Direct Yellow 28, Direct Yellow 29, Direct Dye Colour Index Number 19550 and zinc chromate.

2. A liquid autodish detergent according to claim 1 further comprising:

a) 1-40% silicate;

b) 0-3% surfactant;

c) 5-90% builder;

d) 0-8% of a thickener; and e) 0.01-5% of a stabilizer;

f) 0.02-2% of a defoamer; and g) balance water.

3. The autodish detergent according to claim 2 further comprising 0.002-2% of a perfume composition having perfume selected from the group consisting of dipentene, lemon aldehyde, litsea cubeba oil, lemonile or mixtures thereof.

4. The composition according to claim 3 wherein the colorant is selected from the group consisting of Pigment Yellow 108, Direct Yellow 28, Direct Yellow 29, Direct Dye Colour Index Number 19550, and zinc chromate.

5. The composition according to claim 4 where the perfume composition further comprises one or more of allyl trimethyl hexanone, citronellol, dimyrcetol (dihydromyrcenol/2,6-dimethyl-7-octen-2-ol), dipentene 122, galoxolide 50, geranyl nitrile, hexyl cinnamic aldehyde, isobornyl acetate, lemon terpenes, lime alcohol, lime terpenes, methyl heptenone, methyl nonyl ketone, orivone (4-tertiary pentacyclo hexanone), terpinyl acetate extra, tetrahydro muguol, and 6-acetyl-1,1,3,4,4,6-hexamethyl tetrahydronaphthalene.

6. The composition according to claim 5 wherein the perfume composition further comprises one or more of alcohol C-8, citrotone B, lime alcohol, 3-nonanone, Acetal S Acetate C-9, Alcohol C-9, allyl cyclohexyl propionate, amyl benzoate, cyclo galbanate, decyl methyl ether, Folione, geranyl ethyl ether, greenyl acetate, iso propyl quinolene, linalyl propionate, methyl chavicol, methyl diphenyl ether, methyl octine carbonate, opopanax oil, paracresyl methyl ether, Peru balsam resin, phenyl ethyl butyrate and tetra hydro myrcenol.

7. The composition according to claim 5 wherein the colorant is selected from the group consisting of Pigment Yellow 108, Direct Yellow 28, Direct Yellow 29, Direct Dye Colour Index Number 19550 and zinc chromate.

8. The composition according to claim 7 wherein the colorant is Direct Yellow 28.

9. The composition according to claim 3 wherein the perfume composition further comprises one or more of alcohol C-8, citrotone B, lime alcohol, 3-nonanone, Acetal S acetate C-9, Alcohol C-9, allyl cyclohexyl propionate, amyl benzoate, cyclo galbanate, decyl methyl ether, Folione, geranyl ethyl ether, greenyl acetate, iso propyl quinolene, linalyl propionate, methyl chavicol, methyl diphenyl ether, methyl octine carbonate, opopanax oil, paracresyl methyl ether, Peru balsam resin, phenyl ethyl butyrate and tetra hydro myrcenol.

10. A gel autodish composition according to claim 1 further comprising:

a) 1-40% silicate;

b) 0-3% surfactant;

c) 5-90% builder;
d) 0-5% thickener of chlorine stable polymeric thickener;
e) 0-5stabilizer;
f) 0.02-2% defoamer; and
g) balance water.

11. The composition according to claim 10 further comprising 0.001-2% of a perfume composition having perfume selected from the group consisting of dipentene, lemon aldehyde, litsea cubeba oil, lemonile or mixtures thereof.

12. A granular autodish detergent composition according to claim 1 further comprising:
a) 1-40% silicate;
b) 0.1 to 10% nonionic surfactant;
c) 5-90% builder; and
d) 0-60% filler material.

13. Composition of claim 1 is a container which is a bottle, box or sachet at least part of which is substantially transparent or translucent.

14. A cleaning composition comprising:
a) 0.5-20% of an oxygen bleach;
b) 0.0005-0.2% of a colorant selected from the group consisting of Pigment Yellow 14, Pigment Yellow 74, Pigment Yellow 108, Pigment Yellow 109, Direct Yellow 28, Direct Yellow 29, Direct Dye Colour Index Number 19550 and zinc chromate; and
c) 0.5-2% enzyme, the composition being substantially free from chlorine bleach agent.

* * * * *